US006871634B2

(12) United States Patent
Berger et al.

(10) Patent No.: US 6,871,634 B2
(45) Date of Patent: Mar. 29, 2005

(54) FUEL INJECTION SYSTEM

(75) Inventors: Werner Berger, Markgroeningen (DE); Martin Mueller, Moeglingen (DE); Andreas Glaser, Stuttgart (DE); Anh Tuan Hoang, Tamm (DE); Martin Buehner, Backnang (DE); Cedric Olivier, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/470,521

(22) PCT Filed: Aug. 23, 2002

(86) PCT No.: PCT/DE02/03096

§ 371 (c)(1),
(2), (4) Date: Feb. 6, 2004

(87) PCT Pub. No.: WO03/048561

PCT Pub. Date: Jun. 12, 2003

(65) Prior Publication Data

US 2004/0112338 A1 Jun. 17, 2004

(30) Foreign Application Priority Data

Nov. 30, 2001 (DE) ..... 101 58 788

(51) Int. Cl.[7] ..... F02M 41/00
(52) U.S. Cl. ..... 123/456; 123/468
(58) Field of Search ..... 123/456, 447, 123/467, 468, 469

(56) References Cited

U.S. PATENT DOCUMENTS 2,014,355 A 9/1935 Hussman
4,295,452 A * 10/1981 Lembke et al. ..... 123/470
4,324,276 A 4/1982 Kemner
4,877,187 A * 10/1989 Daly ..... 239/89
6,102,007 A 8/2000 Furst

FOREIGN PATENT DOCUMENTS

| | | | |
|---|---|---|---|
| AT | 004 632 | | 8/2001 |
| AT | 004632 U1 | * | 9/2001 |
| DE | 28 29 057 | | 1/1980 |
| DE | 197 25 076 | | 12/1998 |
| DE | 101 57010 | * | 6/2003 |
| JP | 63-100262 | | 5/1988 |
| JP | 2001-90631 | | 4/2001 |

OTHER PUBLICATIONS

Patent Abstracts of Japan, vol. 2000, No. 21, Aug. 3, 2001.

Patent Abstracts of Japan, vol. 012, No. 340 (M–740), Sep. 13, 1988.

* cited by examiner

*Primary Examiner*—Mahmoud Gimie
(74) *Attorney, Agent, or Firm*—Kenyon & Kenyon

(57) ABSTRACT

A fuel injection system for injecting fuel into an internal combustion engine, including at least one fuel injector and a fuel rail, includes, for each fuel injector, an intake connectible to an intake section of the fuel injector. A corrugated tube is arranged between the intake of the fuel rail and the intake section of the fuel injector. The corrugated tube includes two identical end sections that are able to be brought together concentrically with guide sections of the intake section of the fuel injector and of the intake of the fuel rail. Sealing arrangement are undetachably arranged at the end sections.

10 Claims, 1 Drawing Sheet

FUEL INJECTION SYSTEM

FIELD OF THE INVENTION

The present invention relates to a fuel injection system for injecting fuel into an internal combustion engine.

BACKGROUND INFORMATION

A fuel injection system for supplying fuel to a mixture-compressing internal combustion engine with external ignition as a function of operating characteristics is described in the German Published Patent Application No. 28 29 057. The fuel injection system includes a metal fuel rail connected via at least one branch line to at least one fuel injector, the branch line being configured as a metal tube and being connected to the fuel injector by a screw connection. A readily bendable metal is used as branch line material. Provided between the screw connection on the branch line and the fuel injector is a metallic, thin-walled bellows in the form of a corrugated tube bellows, by which a lateral offset between the starting point of the branch line at the fuel rail and the fitting position of the fuel injector is compensated.

The fuel injection system described in German Published Patent Application No. 28 29 057 provides that the screw connection requires special forms of the corrugated tube bellows. The corrugated tube bellows may not be releasably connected to the screw connection or the fuel rail. Simple, rapid assembly of the fuel rail may be hampered.

A tube line connection in the form of a corrugated tube that is supposed to inhibit or prevent transfer of vibration is described in U.S. Pat. No. 2,014,355. The corrugated tube is surrounded on the outside by a sleeve that does not touch the corrugated tube and is rigidly connected on one end to the one tube section. On its other end, the sleeve is sealed with respect to the other tube section by a flexible seal. A flange of a retaining nut is force-fit into the corrugation arranged in each case at the end of the corrugated tube. The corrugated tube is fastened to adjacent tube sections by the retaining nut.

Other systems include arrangements that include multiple parts and may not permit rapid, simple assembly.

SUMMARY

The fuel injection system according to an example embodiment of the present invention may provide that the corrugated tube is configured as a simple, universally employable component that may be mounted by insertion. Due to the pressure force of the sealant on a sealing line, preassembly is also possible, in which the corrugated tube according to an example embodiment of the present invention is already inserted into the intake of the fuel rail and connected to it, together with the fuel injectors. The corrugated tube according to an example embodiment of the present invention may be manufactured cost-effectively and may be used for a variety of different fuel injection systems.

The end sections may be enclosed radially on the outside by the guide sections, and the guide sections may include a conical entry region.

The sealing device may be made of an elastomer ring supported against a support ring and disposed in a groove.

An elastomer ring may be secured in simple fashion by its inherent tension in a groove.

A locking plate arranged on the guide section may engage in a first corrugation of the corrugated tube.

Loss of the corrugated tube is thereby prevented during subsequent disassembly.

At each end section, the first corrugation of the corrugated tube may be arranged against a grading of the intake, and, correspondingly, of the intake section.

By the guidance at the guide sections, with appropriate configuration of the corrugated tube, the hold-down force for the fuel injector may be exerted via the corrugated tube, since lateral sliding is prevented. In so doing, the seal may not be stressed by the hold-down force.

Example embodiments of the present invention are illustrated in simplified fashion in the drawing and explained further in the following description.

DETAILED DESCRIPTION

Figure 1:
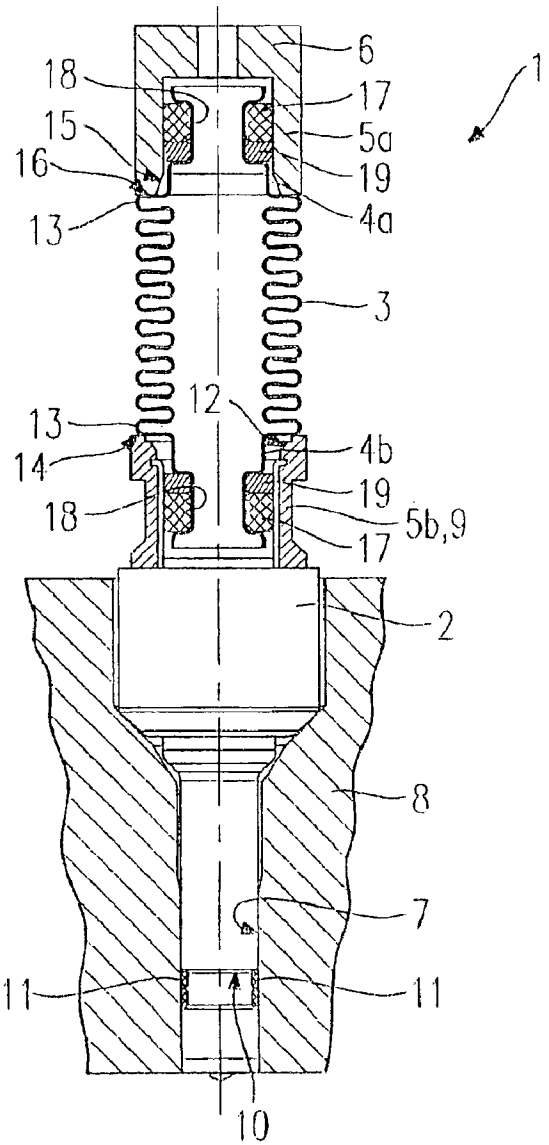
FIG. 1 illustrates a partially cutaway view of an example embodiment of a fuel injection system according to the present invention in the plane of a fuel injector and a corrugated tube.

FIG. 1 illustrates a partially cutaway view of a first example embodiment of a fuel injection system 1 according to the present invention in the plane of a fuel injector 2 and a corrugated tube 3. Corrugated tube 3, illustrated in a cutaway view, is introduced with a first end section 4*a* of two identically configured end sections 4*a*, 4*b* into a first guide section 5*a* of an intake 6 of a fuel rail. Second end section 4*b* is introduced into a second guide section 5*b* formed on an intake section 9 of fuel injector 2.

Fuel injector 2 is inserted into a bore hole 7 of a cylinder head 8 of an internal combustion engine and is illustrated in a cutaway view in the region of intake section 9. Fuel injector 2 is sealed with respect to bore hole 7 by a sealing ring 11 made, for example, of elastomer, arranged in a groove 10.

A conical entry section 12 is formed on intake section 9. A corrugation 13, initially connecting to (being next to) second end section 4*b*, is arranged against a grading 14 of intake section 9. A conical entry section 15 is also formed on intake 6. A corrugation 13, initially connecting to first end section 4*a*, is arranged against a grading 16 of intake 6. Each end section 4*a*, 4*b* is sealed with respect to corresponding guide is section 5*a*, 5*b* by a sealing ring 17 made of elastomer. Sealing ring 17 is positioned in a groove 18 and supported by a support ring 19.

Corrugated tube 3 of fuel injection system 1 according to the present invention may be, e.g., identically constructed for use with fuel injection systems 1 adapted to different installation conditions, and may therefore be produced cost-effectively as a mass-produced part. Simple assembly by insertion is possible, corrugated tube 3 being held against intake 6 or intake section 9 during subsequent assembly by the deformation tension of sealing ring 17 with respect to guide sections 5*a*, 5*b*. Due to its symmetrical configuration, may be impossible to insert corrugated tube 3 the wrong way round. However, an unsymmetrical configuration or a fixed connection between fuel injector 2 and corrugated tube 3, for example, by laser welding, is also possible.

By a suitably rigid configuration of corrugated tube 3, it is possible via gradings 14, 16 to exert a hold-down force from the fuel rail onto fuel injector 2, which holds fuel injector 2 down in bore hole 7 against the combustion pressure. Special hold-down devices may thereby be eliminated. Sealing of corrugated tube 3 with respect to guide sections 5*a*, 5*b* is not adversely influenced by the hold-down tension.

Figure 2:
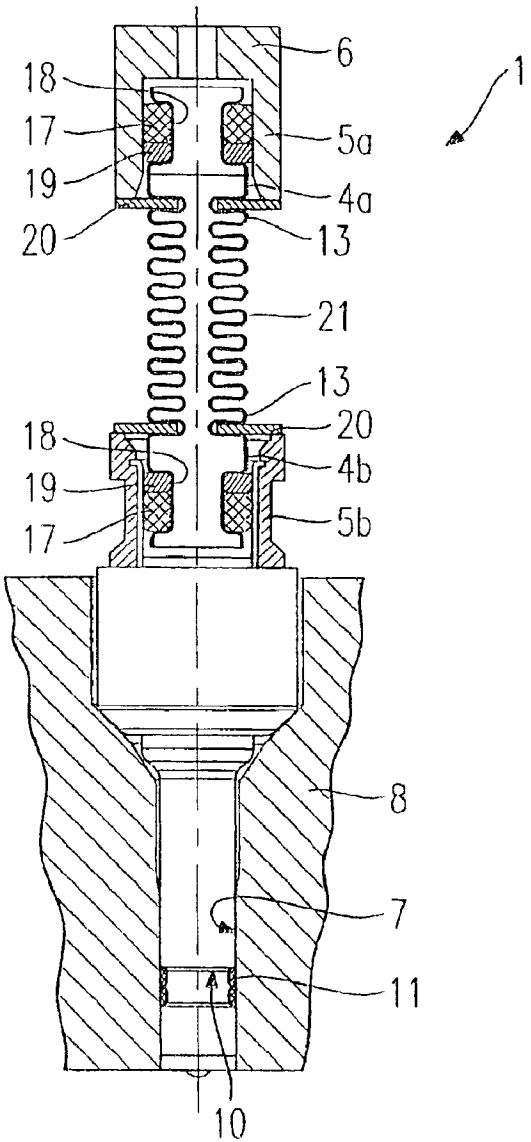
FIG. 2 illustrates an example embodiment of the fuel injection system according to the present invention including a locking plate, in the same view as in FIG. 1.

FIG. 2 illustrates another example embodiment of a fuel injection system 1 according to the present invention including a locking plate 20, in the same view as the corresponding fuel injection system in FIG. 1. Corresponding components are provided with the same reference numerals. A corrugated tube 21, illustrated in a cutaway view, has a smaller diameter compared to the corrugated tube depicted in FIG. 1. First end section 4*a* is inserted into first guide section 5*a* of intake 6 of the fuel rail, and second end section 4*b* is inserted into second guide section 5*b* of fuel injector 2. Each end section 4*a*, 4*b* is sealed by sealing ring 17, arranged in groove 18 and supported by support ring 19, with respect to corresponding guide sections 5*a*, 5*b*.

Fuel injector 2 is inserted in bore hole 7 of cylinder head 8 of the internal combustion engine and is sealed by elastomer sealing ring 11 disposed in groove 10.

Corrugation 13, initially connecting to respective end section 4*b*, lies against corresponding locking plate 20.

Not only is a hold-down force transferred by locking plate 20, but respective end sections 4*a*, 4*b* are also prevented from sliding out of corresponding guide sections 5*a*, 5*b*. If only one of locking plates 20 is removed during disassembly, corrugated tube 21 is held with its other end section 4*a*, 4*b* against the fuel rail or fuel injector 2, and may not be lost.

What is claimed is:

1. A fuel injection system for injecting fuel into an internal combustion engine, comprising:

at least one fuel injector including an intake section;

a fuel rail including an intake connectible to the intake section of the fuel injector;

a corrugated tube arranged between the intake and the intake section of the fuel injector and including two end sections configured to be brought together concentrically with guide sections of the intake section of the fuel injector on one side and with guide sections of the intake on another side; and a seal arrangement undetachably arranged at the two end sections;

wherein the guide sections are arranged to enclose the two end sections; and wherein the guide sections include a conical entry section.

2. A fuel injection system for injecting fuel into an internal combustion engine, comprising:

at least one fuel injector including an intake section;

a fuel rail including an intake connectible to the intake section of the fuel injector;

a corrugated tube arranged between the intake and the intake section of the fuel injector and including two end sections configured to be brought together concentrically with guide sections of the intake section of the fuel injector on one side and with guide sections of the intake on another side; and a seal arrangement undetachably arranged at the two end sections;

wherein the seal arrangement includes an elastomer ring arranged in a groove.

3. The fuel injection system of claim 2, wherein the guide sections are arranged to enclose the two end sections.

4. The fuel injection system of claim 2, further comprising:

a supporting ring arranged to support the elastomer ring.

5. A fuel injection system for injecting fuel into an internal combustion engine, comprising:

at least one fuel injector including an intake section;

a fuel rail including an intake connectible to the intake section of the fuel injector;

a corrugated tube arranged between the intake and the intake section of the fuel injector and including two end sections configured to be brought together concentrically with guide sections of the intake section of the fuel injector on one side and with guide sections of the intake on another side; and a seal arrangement undetachably arranged at the two end sections;

wherein the seal arrangement includes an elastomer glued to the two end sections.

6. The fuel injection system for injecting fuel into an internal combustion engine, comprising:

at least one fuel injector including an intake section;

a fuel rail including an intake connectible to the intake section of the fuel injector;

a corrugated tube arranged between the intake and the intake section of the fuel injector and including two end sections configured to be brought together concentrically with guide sections of the intake section of the fuel injector on one side and with guide sections of the intake on another side;

a seal arrangement undetachably arranged at the two end sections; and a locking plate arranged on each of the guide sections and engaged in a first corrugation of the corrugated tube.

7. A fuel injection system for injecting fuel into an internal combustion engine, comprising:

at least one fuel injector including an intake section;

a fuel rail including an intake connectible to the intake section of the fuel injector;

a corrugated tube arranged between the intake and the intake section of the fuel injector and including two end sections configured to be brought together concentrically with guide sections of the intake section of the fuel injector on one side and with guide sections of the intake on another side; and a seal arrangement undetachably arranged at the two end sections;

wherein at each of the two end sections, a first corrugation of the corrugated tube is arranged against a grading of the intake and of the intake section.

8. The fuel injection system of claim 5, wherein the guide sections are arranged to enclose the two end sections.

9. The fuel injection system of claim 6, wherein the guide sections are arranged to enclose the two end sections.

10. The fuel injection system of claim 7, wherein the guide sections are arranged to enclose the two end sections.

* * * * *